United States Patent [19]

Renz

[11] 4,301,668

[45] Nov. 24, 1981

[54] VEHICLE LOCK ARRANGEMENT

[75] Inventor: Heinz Renz, Aurich, Fed. Rep. of Germany

[73] Assignee: Dr. Ing. h.c.F. Porsche AG, Stuttgart-Zuffenhausen, Fed. Rep. of Germany

[21] Appl. No.: 846,254

[22] Filed: Oct. 27, 1977

[30] Foreign Application Priority Data

Oct. 27, 1976 [DE] Fed. Rep. of Germany ..... 2648677

[51] Int. Cl.[3] ..... E05B 63/00

[52] U.S. Cl. ..... 70/422

[58] Field of Search ..... 70/422, 364 R, 373

[56] References Cited

U.S. PATENT DOCUMENTS 2,890,582 6/1959 Navarro ..... 70/364 R 4,056,955 11/1977 Glass ..... 70/422

*Primary Examiner*—Robert L. Wolfe

*Attorney, Agent, or Firm*—Craig and Antonelli

[57] ABSTRACT

A cylinder lock arrangement which includes a lock housing and a closing cylinder arranged in the lock housing with key-operated tumblers being provided between the closing cylinder and the lock housing. A groove is provided in the housing for accommodating the tumblers, with the tumblers being engageable with the groove when a key is inserted into a key opening of the cylinder lock arrangement. At least one breaking point is provided at the closing cylinder with the tumblers and groove being constructed so that, with a corresponding loading of the closing cylinder, the lock arrangement is always separated at the at least one breaking point.

9 Claims, 2 Drawing Figures

VEHICLE LOCK ARRANGEMENT

Figure 1:
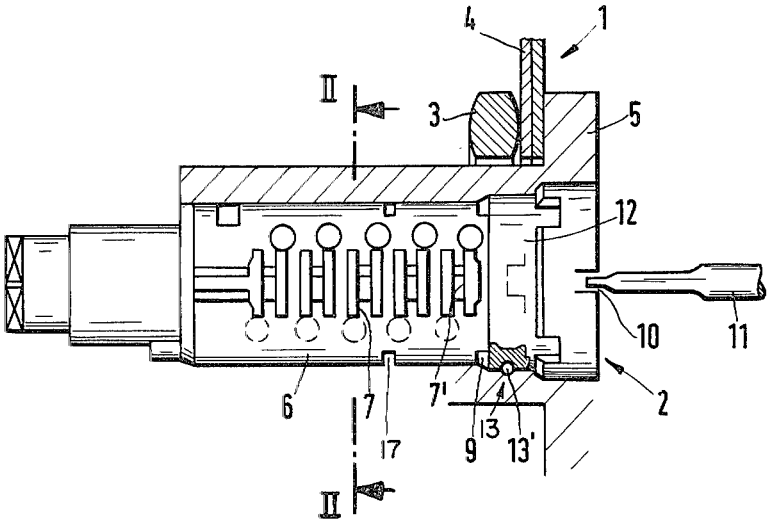

The present invention relates to a lock arrangement and, more particularly, to a cylinder lock arrangement especially for motor vehicle doors, hoods or the like which includes a closing cylinder disposed in a tube-like housing with key-operated tumblers provided between the closing cylinder and housing, which tumblers are engageable in grooves of the housing.

Doors, hoods, lids or the like of motor vehicles are often broken open by thieves inserting a screwdriver into a key opening of the closing cylinder and thereafter rotating the screwdriver in an opening direction so as to turn the tumblers out of the grooves and spring the lock open.

In conventional locks, the turning out of the tumblers from the grooves is additionally facilitated in that shanks, defining or bounding the tumblers, normally extend parallel to side edges of the tumblers or diverge in the direction of the respective side edges. Moreover, in tumblers with new locks, lubricating material deposits between tumblers and grooves also facilitate the turning out of the tumblers.

The aim underlying the present invention essentially resides in providing a cylinder lock arrangement which is secure to a considerable degree against break-ins.

According to one advantageous feature of the present invention, at least one breaking point is provided at the closing cylinder, which breaking point results in a separation between the tumbler assembly and a front portion of the lock upon the application of a predetermined force by an auxiliary tool such as a screwdriver or the like. By virtue of the provision of the breaking points, it is not possible to turn the tumblers out of the groove of the lock housing without using an authorized key.

According to a further advantageous feature of the present invention, the tumblers and the grooves are constructed in such a way that with a corresponding loading of the closing cylinder, the lock arrangement will always separate at the breaking point.

Preferably, according to the present invention, the breaking point is formed by a groove-like recess arranged between the first tumbler and an opening for receiving a key. Moreover, it is also possible according to the present invention to arrange a plurality of breaking points, one behind the other, at the closing cylinder of the lock arrangement.

In accordance with yet another feature of the present invention, the grooves of the lock housing are trapezoidal-shaped with the side shanks of the groove converging in a direction of the tumblers from the outer rim of the housing such that the respective tumblers support themselves at the shanks of the groove and ensure a breaking along the breaking point.

According to a further feature of the present invention, means are provided for locking a part of the closing cylinder between the breaking point and a key opening in an axial direction so as to prevent removal of the part separated at the breaking point and facilitate subsequent alignment by an authorized key to open the lock.

The advantage especially obtained with the present invention reside in providing a lock arrangement which, with an attempt to break open the cylinder lock by an auxiliary tool such as, for example, a screwdriver, the closing cylinder is separated at at least one breaking point so that an over-pressing or forcing of the connection tumbler and groove is counteracted. Moreover, by forming the breaking point as a groove arranged at the closing cylinder, it is possible to provide a lock arrangement having a minimum number of manufacturing and/or operating problems.

Accordingly, it is an object of the present invention to provide a lock arrangement which avoids by simple means disadvantages and shortcomings encountered in the prior art.

Another object of the present invention is to provide a lock arrangement which minimizes if not eliminates unauthorized entry.

Yet another object of the present invention resides in providing a lock arrangement which functions reliably.

A still further object of the present invention resides in providing a lock arrangement which is simple in construction and, therefore, inexpensive to manufacture.

Figure 2:
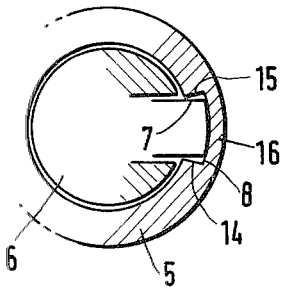

These and other objects, features, and advantages of the present invention will become more apparent from the following description when taken in connection with the accompanying drawings which show, for the purposes of illustration only, one embodiment in accordance with the present invention, and wherein:

FIG. 1 is a partially schematic cross-sectional view of the cylinder lock arrangement in accordance with the present invention; and FIG. 2 is a partial cross-sectional view taken along the line II—II in FIG. 1.

Referring now to the drawings, wherein like reference numerals are used in both views to designate like parts and, more particularly, to FIG. 1, according to this figure, a cylinder lock generally designated by the reference numeral 2 is mounted, for example, in a wall 4 of a door generally designated by the reference numeral 1 by a mounting element such as, for example, a bolt or a screw 3. The cylinder lock includes a tubular-shaped lock housing 5 and a closing cylinder 6 arranged therein. A plurality of tumblers 7 are arranged between the housing 5 and closing cylinder 6 with the tumblers 7 being engageable and accommodated in a groove 8 of the housing 5. The tumblers 7 are disengaged from groove 8 when a key (not shown) is inserted in the lock 2 and is turned or rotated so as to open the lock 2.

A predetermined breaking point 9 is provided at the closing cylinder 6 between a first tumbler 7' and an opening 10 for receiving the key (not shown). The breaking point 9 is formed as a local or radial circular groove-like recess.

If an attempt is made to break open the lock 2 by an instrument such as, for example, a screwdriver 11 applied at the key opening 10, the closing cylinder 6 is separated from the tumbler assembly at the breaking point 9 so as to result in a separated part 12.

To prevent displacement of the separated part 12 of the closing cylinder 6 in an axial direction, blocking means generally designated by the reference numeral 13 may be provided. The blocking means 13 includes a ball 13' arranged between the separated part 12 and a portion of the door 1. By virtue of the provision of the blocking means 13, accessibility of the closing cylinder 6 and/or tumbler assembly behind separated part 12 is avoided. Moreover, by preventing axial displacement of the separated part 12, it is possible to align separated part 12 with a corresponding key so that the lock 2 can be opened.

If desired, a plurality of breaking points may be provided at the closing cylinder 6 with each breaking point being dimensioned in such a way that the first breaking point 9 is detached before or ahead of the second breaking point 17 and the second breaking point before the third breaking point, and so forth. In the illustrated embodiment, a second breaking point 17 is arranged at the tumbler assembly behind the first breaking point 9, as viewed in a key insertion direction.

As shown in FIG. 2, the groove 8 which is engaged by the tumblers 7 has a trapezoidal shape with shanks 14, 15, defining or limiting the tumblers 7, converging from a rim 16 of the housing 5 in a direction towards the straight side edges of the tumblers 7.

While I have shown and described only one embodiment in accordance with the present invention, it is understood that the same is not limited thereto, but is susceptible of numerous changes and modifications as known to those skilled in the art to which it pertains, and I therefor do not wish to be limited to the details shown and described hereinabove, but intend to cover all such changes and modifications as are encompassed by the scope of the appended claims.

I claim:

1. A cylinder lock arrangement which includes a lock housing, a closing cylinder arranged in the lock housing, key-operated tumblers provided between the closing cylinder and the lock housing, and a groove means provided in the housing for accommodating the tumblers, characterized in that at least one breaking point is provided at the closing cylinder, the tumblers and groove means are constructed so that, with a corresponding loading of the closing cylinder, the lock arrangement is always separated at the at least one breaking point, and in that means are provided for preventing axial displacement of a separated portion of the closing cylinder between the breaking point and an opening for receiving a key.

2. A cylinder lock arrangement according to claim 1, in a vehicle which includes doors and a hood, characterized in that the lock arrangement is mounted in at least one of the doors and hood of the vehicle.

3. A cylinder lock arrangement according to claim 1, characterized in that the at least one breaking point includes a groove-like recess provided at the closing cylinder.

4. A cylinder lock arrangement according to claim 3, characterized in that the at least one breaking point is arranged between a first of the tumblers and an opening for receiving a key.

5. A cylinder lock arrangement according to claim 3, characterized in that a plurality of breaking points are arranged one behind the other at the closing cylinder.

6. A cylinder lock arrangement according to claim 5, characterized in that the groove means has a trapezoidal shape and includes lateral shanks which converge from a rim of the lock housing in a direction toward the tumblers.

7. A cylinder lock arrangement according to claim 1, characterized in that the at least one breaking point is arranged between a first of the tumblers and an opening for receiving a key.

8. A cylinder lock arrangement according to claim 1, characterized in that a plurality of breaking points are arranged one behind the other at the closing cylinder.

9. A cylinder lock arrangement according to claim 1, characterized in that the groove means has a trapezoidal shape and includes lateral shanks which converge from a rim of the lock housing in a direction toward the tumblers.

* * * * *